US007077090B2

(12) United States Patent
Sailer et al.

(10) Patent No.: US 7,077,090 B2
(45) Date of Patent: Jul. 18, 2006

(54) VALVE TRAIN WITH HYDRAULIC LASH ADJUSTMENT

(75) Inventors: Peter Sailer, Erlangen (DE); Oliver Schnell, Veitsbronn (DE); Friedrich Hieronymus, Willmersbach (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 11/102,011

(22) Filed: Apr. 8, 2005

(65) Prior Publication Data

US 2005/0229886 A1 Oct. 20, 2005

(30) Foreign Application Priority Data

Apr. 21, 2004 (DE) ..... 10 2004 019 282

(51) Int. Cl.
*F01L 1/14* (2006.01)

(52) U.S. Cl. ..... 123/90.52; 123/90.48; 123/90.33; 123/90.35; 123/90.36; 123/90.61

(58) Field of Classification Search ..... 123/90.52, 123/90.61
See application file for complete search history.

(56) References Cited

U.S. PATENT DOCUMENTS

| | | | | |
|---|---|---|---|---|
| 3,054,392 | A * | 9/1962 | Thompson | 123/90.35 |
| 4,004,558 | A * | 1/1977 | Scheibe | 123/90.35 |
| 5,394,843 | A * | 3/1995 | Decuir | 123/90.39 |
| 6,782,855 | B1 * | 8/2004 | Albertson et al. | 123/90.33 |
| 2002/0096136 | A1 | 7/2002 | Spath et al. | |

FOREIGN PATENT DOCUMENTS

| | | |
|---|---|---|
| DE | 1 983 334 | 4/1968 |
| DE | 1 985 446 | 5/1968 |
| DE | 1 293 788 | 4/1969 |
| DE | 199 19 245 | 11/2000 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

Valve train with hydraulic lash adjustment in the entire timing train, in which oil is delivered from the oil supply space of the hydraulic valve-lash adjuster (HLA) to the valve rocker arm via a hollow push rod, a choke limiting the oil discharge, the choke being designed in such a way that it seals off the push rod bore at the top when the oil pressure drops, that is to say when the engine is shut off, so that the oil is retained in the push rod bore (12) until—after the engine is started—the choke body (15, 22) opens up the discharge opening again.

4 Claims, 3 Drawing Sheets

VALVE TRAIN WITH HYDRAULIC LASH ADJUSTMENT

FIELD OF THE INVENTION

The invention relates to a valve train with hydraulic lash adjustment in the entire timing train, in which oil is delivered from the oil supply space of the hydraulic valve-lash adjuster (HLA) to the valve rocker arm via a hollow push rod, a choke limiting the oil discharge.

In hydraulic valve-lash-adjusting elements, a certain supply volume is necessary so that a lowered element, in particular during cold starting, does not chatter. In this case, the elements which are matched to the valve lift are most at risk. If the supply volume is too small, or if the supply space has run dry for other reasons, while the engine has stopped, a situation may arise in which, when the engine is subsequently started, too little oil is available in order to be able to adjust the element from blocked position to fitting position. Chattering of the push rod would be a consequence thereof.

In order to avoid this, it has already been proposed (cf., for example, U.S. Ser. No. 2002/0096136 A1) to provide a movable separating disc between the working plunger of the hydraulic valve-lash adjuster and the plunger top part, this separating disc being intended to prevent an excessive drop in the oil flow. In this solution, however, the volumetric oil flow is greatly affected by tolerances due to the disc, so that this solution is not satisfactory in all points.

DESCRIPTION OF THE INVENTION

The object of the invention is therefore to develop a valve train of the type mentioned at the beginning in such a way that, when the engine is shut off, an assured greater oil supply for filling the oil supply space of the hydraulic valve-lash adjuster is available.

To achieve this object, provision is made according to the invention for the choke in the region of the top end of the hollow push rod to be designed in such a way that it seals off the push rod bore at the top when the oil pressure drops, that is to say when the engine is shut off, so that the oil is retained in the bore until—after the engine is started—the choke body opens up the discharge opening again.

Due to the design according to the invention, when the engine is shut off, the oil located in the bore of the push rod is retained as additional oil supply according to the pipette principle, so that, when the engine is started again, this oil can run off downwards and can pass into the oil supply space of the hydraulic valve—lash adjuster, so that sufficient oil is available from the beginning in order to avoid the chattering, mentioned at the beginning, of valve parts when the engine is being started.

In a development of the invention, provision may be made for the choke to be arranged in an oil-discharge bore of the rocker arm following a bearing cup for accommodating a through-bored bearing ball at the top end of the push rod. The bearing ball engages in the bearing cup in a sealing manner, so that, by the alternating complete sealing and opening-up of the oil-discharge bore with the choke, the oil supply in the push rod can be retained as mentioned, and it can be released again by lifting the choke body from the sealing position.

In the simplest case, the choke here may comprise an essentially cylindrical choke body which is mounted in a bearing bore with clearance and is pressed by gravitational force or a return spring into the bottom shut-off position onto a sealing shoulder of a narrowed connecting bore.

BRIEF DESCRIPTION OF THE DRAWINGS

Further advantages, features and details of the invention follow from the description below of an exemplary embodiment and with reference to the drawing, in which.

DETAILED DESCRIPTION OF THE INVENTION

Figure 1:
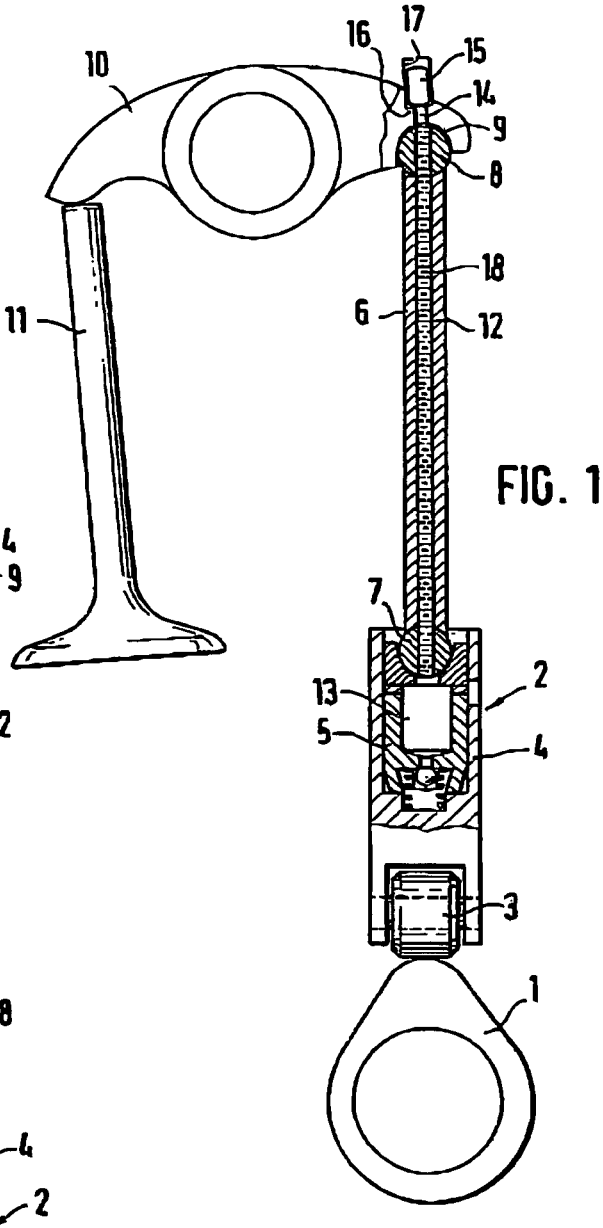
FIG. 1 shows a schematic illustration of a valve train according to the invention with a choke body, mounted on the rocker arm and sealing off the oil bore of the push rod, in the shut-off position when the engine is switched off.
Figure 2:
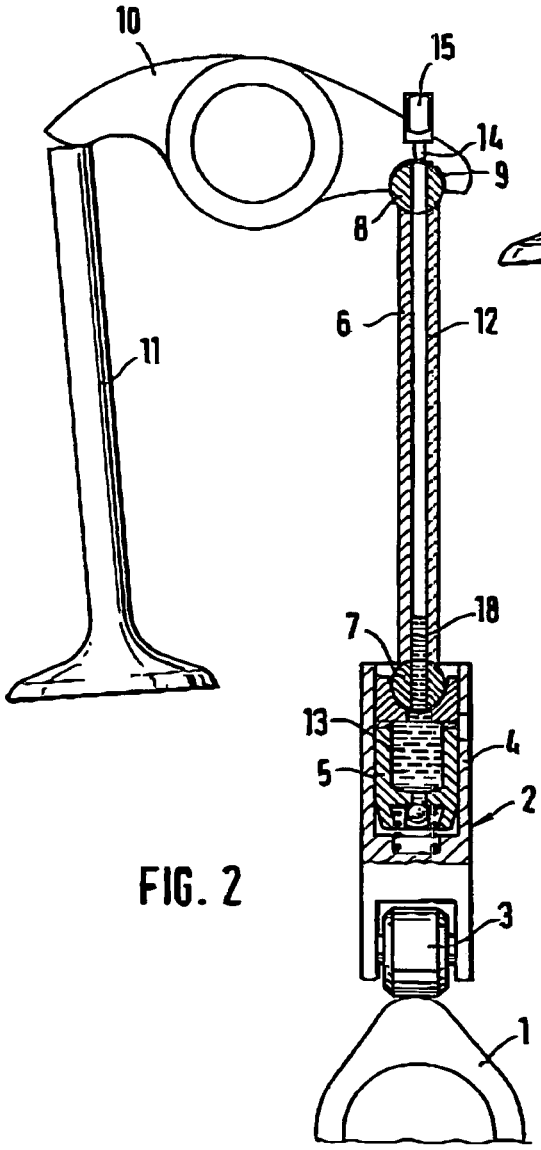
FIG. 2 shows a schematic illustration of the valve train according to FIG. 1 after the engine has been started and after the choke body has been lifted as a result.

The camshaft with an overhead-valve (OHV) valve train 2 sitting thereon can be seen schematically at 1 in FIG. 1, the valve train 2, in addition to the cam roller 3, the housing 4 and the plunger 5, having a hollow push rod 6 with a bearing ball 7 at the bottom end and a bearing ball 8 at the top end, the bearing ball 8 engaging in a bearing cup 9 of the rocker arm 10 in order to actuate the valve 11. The push rod 6 is hollow, and its internal bore 12 connects the oil supply space 13 to an oil-discharge opening for lubricating the contact points in the valve train. In the exemplary embodiment according to FIGS. 1 and 2, following the internal bore 12, continuing into the bearing ball 8, of the push rod 6, a bore 14 is arranged in the rocker arm, a choke body 15 being arranged in a widened bore at the end of this bore 14 in such a way as to be displaceable with relatively tight clearance. Shown in FIG. 1 is the position in which, due to the gravitational force, this choke body has descended onto a sealing shoulder 16 between the widened inner bore 17 for accommodating the choke body 15 and the bore 14, which always happens when the engine is shut off and thus no oil is subsequently forced from below. As a result, however, the entire hollow interior space, that is to say the bore 12 of the push rod 6, is sealed off, so that oil is retained in this bore according to the pipette principle. It is not until after the engine is started again, when the choke body 15 has lifted from the sealing shoulder 16, that the oil flows downwards from the push rod 6 into the hydraulic valve-lash adjuster. The problems mentioned at the beginning with chattering valve parts can be reliably avoided by this increased oil supply. The oil column present in each case is designated by 18 in the figures.

Figure 3:
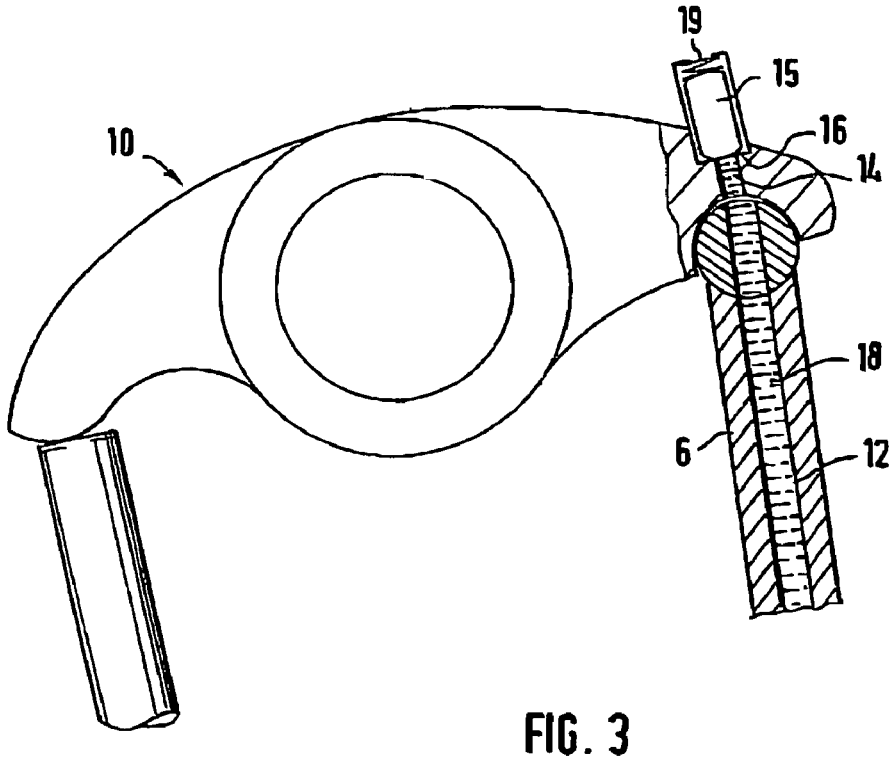
FIG. 3 shows an enlarged partial view of a modified embodiment in which the sealing body is spring-loaded.

In the modified exemplary embodiment according to FIG. 3, the choke body 15 is loaded by a spring 19 which, in addition to the gravitational force, presses it downwards onto the sealing shoulder 16 into the sealing position, so that the oil column 18 is retained in the bore 12 of the push rod 6 according to the pipette principle and can thus flow off downwards for filling the oil supply of the hydraulic valve-lash adjuster when the engine is restarted.

Figure 4:
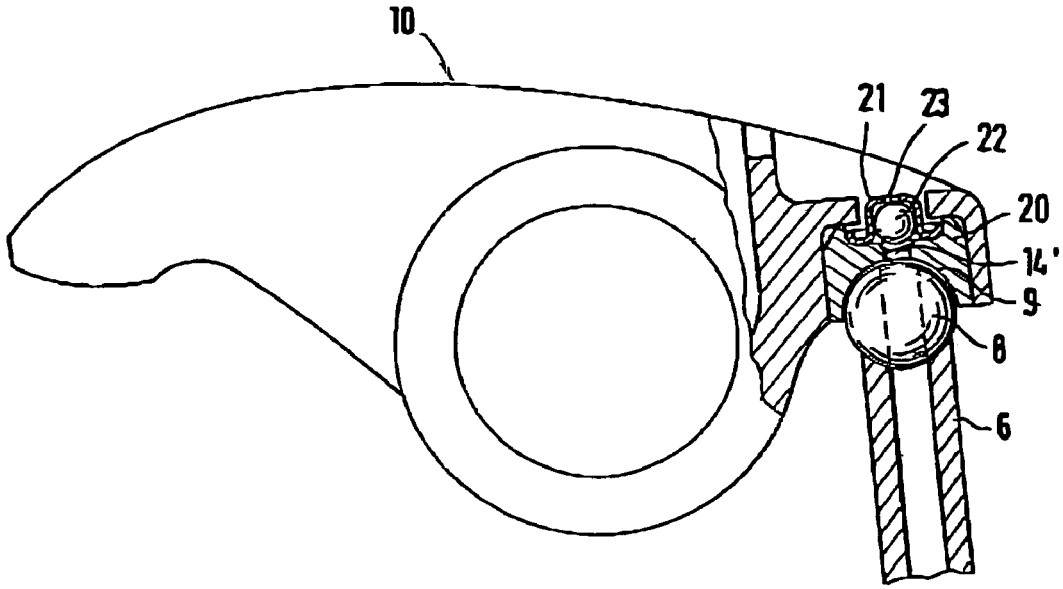
FIG. 4 shows an illustration of the rocker arm with a modified design of a choke which is inserted there as a press-in part.

FIG. 4 shows an exemplary embodiment in which a press-in part 20 is inserted into the rocker arm 10, and this press-in part 20, in addition to the cup 9 for the bearing ball 8 at the top end of the push rod 6, has a cap-shaped sheet-metal part 21, in which a ball 22 mounted with a slightly smaller diameter, that is to say with a certain clearance, is arranged as choke body. The oil-discharge opening 23 at the top end of the sheet-metal part 21 is designed in such a way that, in the lifted position according to FIG. 4, oil can flow through upwards between ball and inner wall of the sheet-metal parts and can discharge through a part of this opening 23 that remains clear. When the engine is shut off, the ball—if need be assisted by a spring (not shown)—drops down and seals off the narrowed bore 14'. As already described, the oil is again retained in the interior of the hollow push rod according to the pipette principle and thus the hollow interior space of the push rod 6 forms an additional oil supply space for the hydraulic valve-lash adjuster.

Figure 5:
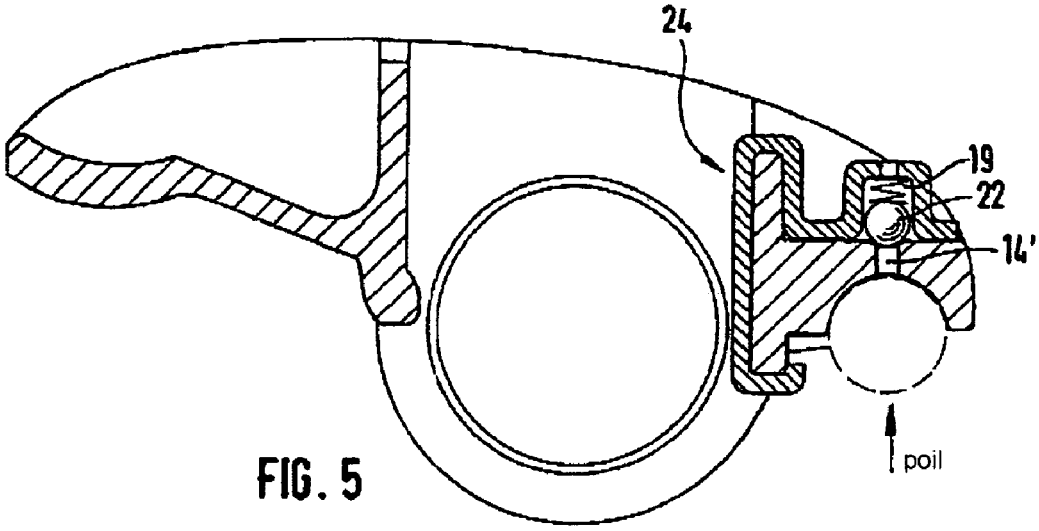
FIGS. 5 and 6 show further modified exemplary embodiments of the design according to FIG. 4.

FIG. 5 shows a modified exemplary embodiment of the arrangement according to FIG. 4, a return spring 19, which is absent in the arrangement according to FIG. 4, being included in this exemplary embodiment. The retaining clip 24 used in this case and having an integrated oil-retaining and choke element, is of very simple construction and has the advantage that the oil-retaining and choke element can be fitted in a very simple manner, to be precise without further machining of the valve rocker arm.

Figure 6:
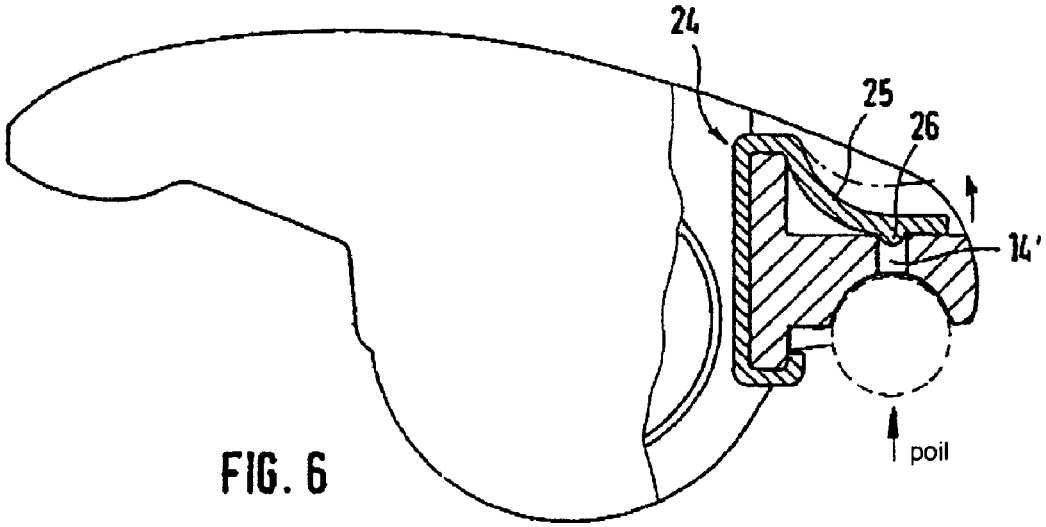

The arrangement according to FIG. 6 shows an embodiment in which the retaining clip 24 is provided with an elastically mounted oil-retaining strap 25 which, in addition to having a spherical segment 26, lifts when engine pressure ($p_{oil}$) is applied and chokes the lubricating flow. As soon as the engine is shut off, the elastic oil-retaining strap presses down on the discharge opening of the bore 14' and in this way seals off the inner bore 12, adjoining at the bottom and not depicted in FIGS. 5 and 6, of the push rod 6. It can be seen that the exemplary embodiment according to FIG. 6 is of extremely simple design with few components.

The invention is not restricted to the exemplary embodiments shown. In particular, the choke need not necessarily be arranged in the region of the top end of the push rod; it is sufficient for the non-return member for holding the oil column in the push rod to be situated at this point. The choke could also be arranged separately from it at another point.

DESIGNATIONS

1 Camshaft
2 (OHV) valve train
3 Cam roller
4 Housing
5 Plunger
6 Hollow push rod
7 Bearing ball
8 Bearing ball
9 Bearing cup
10 Rocker arm
11 Valve
12 Internal bore of the push rod
13 Oil supply space
14 Bore in the rocker arm
14' Narrowed bore
15 Choke body
16 Sealing shoulder
17 Internal bore
18 Oil column
19 Spring
20 Press-in part
21 Sheet-metal part
22 Ball
23 Oil-discharge opening
24 Retaining clip
25 Oil-retaining strap
26 Spherical segment

The invention claimed is:

1. A valve train with hydraulic lash adjustment in the entire timing train, in which oil is delivered from the oil supply space of the hydraulic valve-lash adjuster (HLA) to the valve rocker arm via a hollow push rod, a choke limiting the oil discharge, characterized in that the choke is designed in such a way that it seals off the push rod bore at the top when the oil pressure drops, that is to say when the engine is shut off, so that the oil is retained in the push rod bore (12) until—after the engine is started—the choke body (15, 22) opens up the discharge opening again wherein a retaining clip having an integrated oil-retaining and choke element is inserted into a recess of the valve rocker arm.

2. The valve train according to claim 1, wherein the choke is arranged in an oil-discharge bore (14, 14') of the rocker arm (10) following a cup (9) for accommodating a through-bored bearing ball (8) at the top end of the push rod (6).

3. The valve train according to claim 1, wherein the choke comprises an essentially cylindrical choke body (15) which is mounted in a bearing bore with tight clearance and is pressed by gravitational force or a return spring (19) into the bottom shut-off position onto a sealing shoulder (16) of a narrowed connecting bore (14).

4. The valve train according to claim 1, wherein the retaining clip 24 is provided with an elastically mounted retaining-oil strap forming the choke.

* * * * *